United States Patent [19]

West

[11] 4,284,038

[45] Aug. 18, 1981

[54] RECIPROCATING DRIVE MEANS

[75] Inventor: Frank E. West, 12 Newbury Dr., Bournemouth, Dorset, England

[73] Assignees: Baron Hire Limited; Frank Edward West, both of England

[21] Appl. No.: 78,844

[22] Filed: Sep. 25, 1979

[30] Foreign Application Priority Data

Sep. 29, 1978 [GB] United Kingdom ..... 38712/78

[51] Int. Cl.[3] ..... F01B 15/06; F02B 71/00

[52] U.S. Cl. ..... 123/46 A; 91/216 B; 91/290; 123/61 R

[58] Field of Search ..... 123/61 R, 46 R, 46 A; 91/216 B, 290, 297, 298

[56] References Cited

U.S. PATENT DOCUMENTS

| | | | |
|---|---|---|---|
| 784,320 | 3/1905 | Grose | 91/297 |
| 1,598,426 | 8/1926 | Ditson | 91/290 X |
| 2,787,223 | 4/1957 | Sargent | 91/216 B X |

*Primary Examiner*—Tony M. Argenbright

*Attorney, Agent, or Firm*—Thomas E. Beall, Jr.

[57] ABSTRACT

Reciprocating drive means powered by a fluid such as compressed air comprising an elongate inner member with a plurality of passageways therein, an outer member slidable on the inner member and a shuttle member slidable with respect to the inner member and within the outer member, the passageways in the inner member being variously and intermittently so connected in use to each other by way of ports in the inner member and compartments provided within the outer member and the shuttle that, upon connection of a determined one of said passageways to a fluid pressure source the outer member moves with reciprocating action with respect to the inner member. The inner member has two fixed discs thereon, between which discs the shuttle member can oscillate, the discs having seals on their peripheral surfaces to seal against the inner wall of the outer member, the outer member is cylindrical with end walls having seals slidable on the inner member and cooperating with ports therein and the shuttle member has axially spaced seals on its inner peripheral surface to cooperate with ports in the inner member and to seal against the inner member and define one of the compartments therebetween. Following movement of the outer member in one direction of movement, the shuttle member is moved by pressure in an opposite direction to cause the outer member to move in said opposite direction.

8 Claims, 6 Drawing Figures

RECIPROCATING DRIVE MEANS

The invention relates to reciprocating drive means.

Reciprocating drive means have been previously proposed to produce a reciprocating piston-like movement for which there are many uses in industry. Such reciprocating drive means may be powered by compressed air, in which case they normally require various flow control valves or operate on a constant controlled bleed. Thus they are, due to the complexity of the valves, relatively expensive to manufacture or if a controlled bleed is used, its range of uses is unduly limited.

The invention has among its objects to provide reciprocating drive means which is simple and inexpensive to manufacture, avoids any requirements for valves but is reliable and efficient in operation.

Thus the invention provides a reciprocating drive means comprising an elongate inner member with a plurality of passageways therein, two fixed plates on said inner member, an outer member slidable on said inner member, a seal at the peripheral surfaces of each of said fixed plates to seal against the inner face of the wall of said outer member, an end wall on said outer member with a seal at said end wall slidable on said inner member, a shuttle member slidable with respect to said inner member between said two fixed plates and within said outer member, a seal at the outer peripheral surface of said shuttle member to seal against said inner face of the wall of said outer member and axially spaced sealed at the inner peripheral surface of said shuttle member to seal against said inner member, a first compartment formed between said axially spaced seals, ports in said inner member communicating respective ones of said passageways in said inner member with the surface thereof, said ports co-operating in use with the relatively moving said outer member and said shuttle member to effect valving operations to interconnect said passageways with one another and with compartments formed between said inner member and said outer member and separated from one another by said fixed plates and said shuttle member.

Preferably the unit is double ended and symmetrical about a mid-position in its length with a second end wall on the outer member at the end opposite to that at which said end wall is provided.

Connection of a determined one of said passageways with a source of fluid pressure causes said outer member to move in one direction of movement with respect to said inner member followed by movement of said shuttle member in an opposite direction of movement on said inner member to cause said outer member to move in said opposite direction of movement followed by movement of said shuttle member in one direction of movement.

Advantageously in operation the fluid supplied axially through said determined one of the passageways in the elongate member passes to said first compartment. Depending upon the position of the shuttle member, fluid from said first compartment passes to one or other of a second passageway and a third passageway and respectively either to a second compartment between the first of the fixed plates and a first of the end walls of the outer member or to a third compartment between the second of the fixed plates and a second of the end walls of the outer member, thereby to move the outer member axially with respect to the inner member in one direction or the other.

When the compartment pressurized is the second compartment, at the end of such movement of the outer member the leading, first end wall thereof passes over a port, which was venting to atmosphere a fourth compartment between the fixed plate adjacent such first end wall and the adjacent end of the shuttle member thereby allowing fluid from said second compartment to pass through a fourth passageway to pressurize said fourth compartment to move the shuttle member to cause fluid from said first compartment to pass to said third passageway and thereby to pressurize said third compartment to cause the outer member to move in the opposite direction with respect to the elongate member. When, during said opposite direction of movement, the second end wall passes over a port which was venting to atmosphere a fifth compartment between the second fixed plate and the adjacent end of the shuttle member, pressure from said third compartment passes through a fifth passageway to pressurize said fifth compartment and move the shuttle member towards said first fixed plate to initiate repetition of the cycle.

During expansion of the second compartment the third compartment is vented through the third passageway, the fifth compartment and the fifth passageway and during expansion of the third compartment the second compartment is vented through the second passageway, the fourth compartment and the fourth passageway.

The elongate member can be a cylindrical shaft with a core member formed as a five-armed spider tightly fitted therein to form the said passageways.

While the preferred fluid pressure source is compressed air i.e. a positive pressure source, it could equally be a vacuum, i.e. a negative pressure source. The drive means is also suitable for use with other fluids, for example water.

While the inner and outer members are preferably cylindrical and the fixed plates are preferably disc shaped, the elongate inner member could be in the form of a flat member with the passageways arranged in a row and with the outer member and shuttle members sliding thereover in the form of pressure pads.

The invention is diagrammatically illustrated by way of example in the accompanying drawings, in which.

Figure 1:
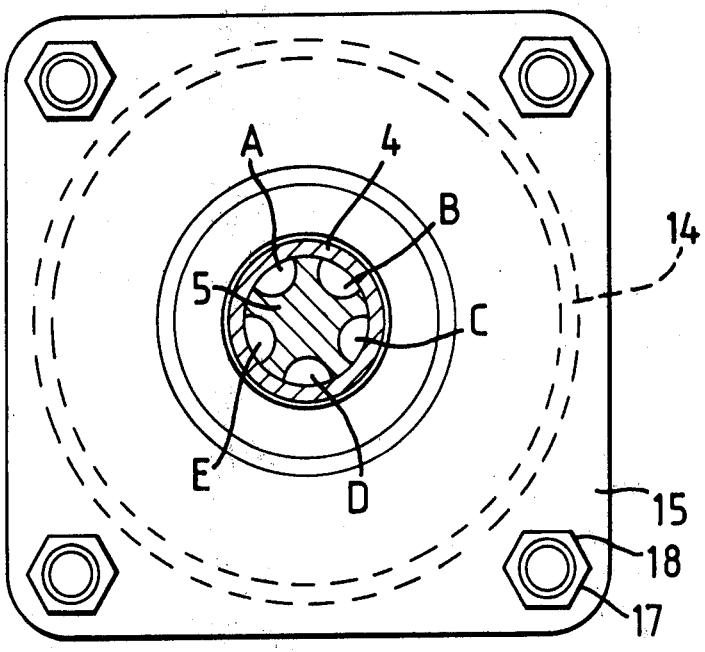
FIG. 1 is a part sectional end view, taken on line I—I of FIG. 2, of reciprocating drive means according to the invention.

Referring to the drawings, reciprocating drive means comprises an elongate inner member 1, an outer member 2 slidable on the inner member 1 and a shuttle member 3 slidable on the inner member 1 and within the outer member 2.

The elongate inner member 1 is formed as a cylindrical shaft 4 with a core member 5 therein which, with the inner wall of the cylindrical shaft 4, forms five passages A, B, C, D, E. The elongate member 1 has a middle portion 6 of large diameter, on each side of the middle portion 6 an intermediate portion 7 of smaller diameter and end portions 9 of still smaller diameter. Fixed discs 11 and 12 are secured one on each of the intermediate portions 7 by means of nuts 13, the discs 11 and 12 including sealing means 8 which seal against an outer cylindrical wall 14. The cylindrical wall 14, together with end plates 15 and 16 secured thereto by nuts 17 and rods 18, forms the outer member 2. Seals 19 are provided in the end plates 15 and 16 to seal on the shaft end portions 9.

The shuttle member 3 comprises a collar 20 which mounts spaced-apart inner seals 21, 22 between which the collar 20 defines, with the outer surface of the middle portion 6 of the elongate member 1, a compartment 23. The collar 20 also mounts outer seals 24 and 25 which bear against the inner wall of the cylindrical member 14. Apertures are provided in the wall of the cylindrical shaft 4 to communicate the passages A–E with compartments located externally of the cylindrical shaft, such apertures being referred to by lower case letters corresponding to the letter of the passageway A–E with which they communicate and being further identified by a subscript numeral.

Operation of the reciprocating drive means is explained with reference to FIGS. 3 to 7.

Figure 3:
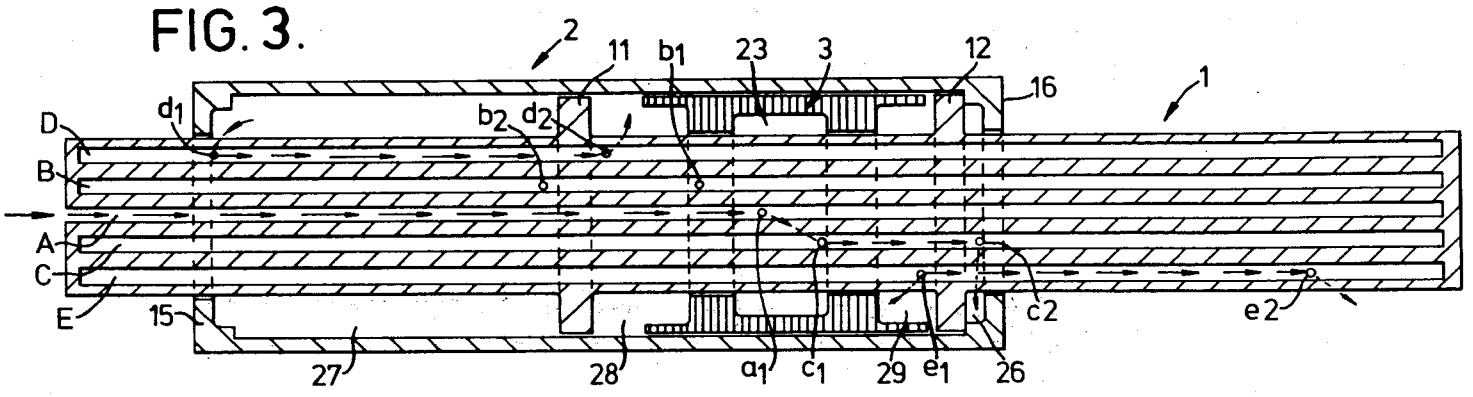
FIGS. 3, 4, 5 and 6 are schematic illustrations showing sequential positions in operation of the reciprocating drive means of FIGS. 1 and 2.

Referring first to FIG. 3, the outer member 2 is shown in an extreme leftward position with respect to the inner member 1 and the shuttle member 3 is shown moving into a rightward position. Air is supplied as indicated by the arrow at the lefthand side of FIG. 3 to passageway A and passes through an aperture a1 into the compartment 23 within the shuttle member 3, then through an aperture c1 into the passageway C and from the passageway C through an aperture c2 into a compartment 26 between the fixed disc 12 and the end plate 16 of the outer member 2. Pressure build-up in the compartment 26 causes the outer member 2 to move rightwardly. Air in a compartment 27 between the fixed disc 11 and the end wall 15 of the outer member 2 passes into passageway D through an aperture d1 and through an aperture d2 into a compartment 28 between the fixed disc 11 and the shuttle member 3 thereby pushing the shuttle member 3 to its extreme rightward position.

As the shuttle member 3 moves rightwardly, air in a compartment 29 between the shuttle member and the fixed disc 12 passes through an aperture e1 into passageway E and exhausts through an aperture e2 to atmosphere.

Figure 4:
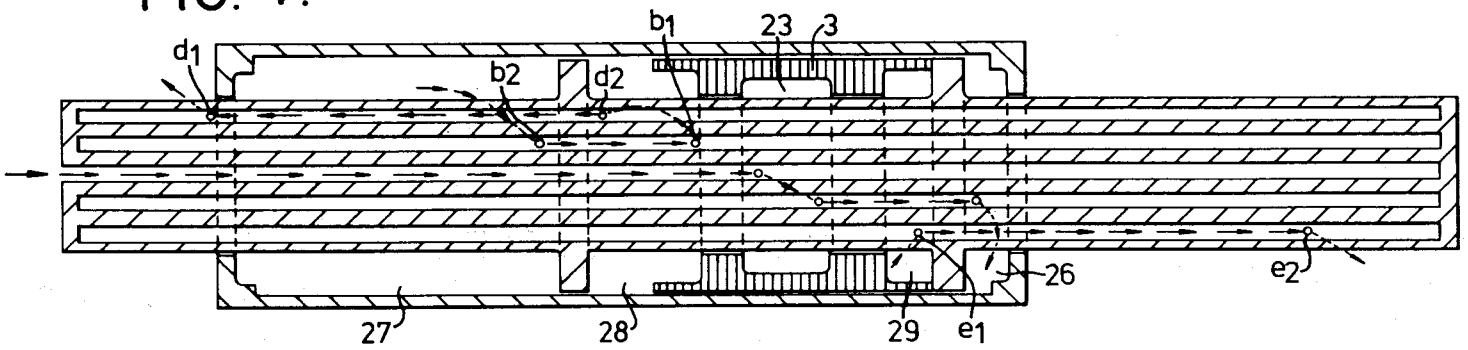

With reference to FIG. 4, as the outer member 2 begins to move rightwardly the end wall 15 moves rightwardly of the aperture d1 thereby allowing air from the compartment 27 to pass through an aperture b2, along passageway B, out through an aperture b1 into the space 28, through aperture d2 into passageway D and exhaust to atmosphere through aperture d1.

Since the compartment 29 is connected to atmosphere through aperture e1, passageway E and aperture e2, the shuttle member 3 moves completely to its rightward position and is further biassed to its rightward position by frictional engagement with the cylindrical wall 14 of the outer member 2 which is moving thereover.

Figure 5:
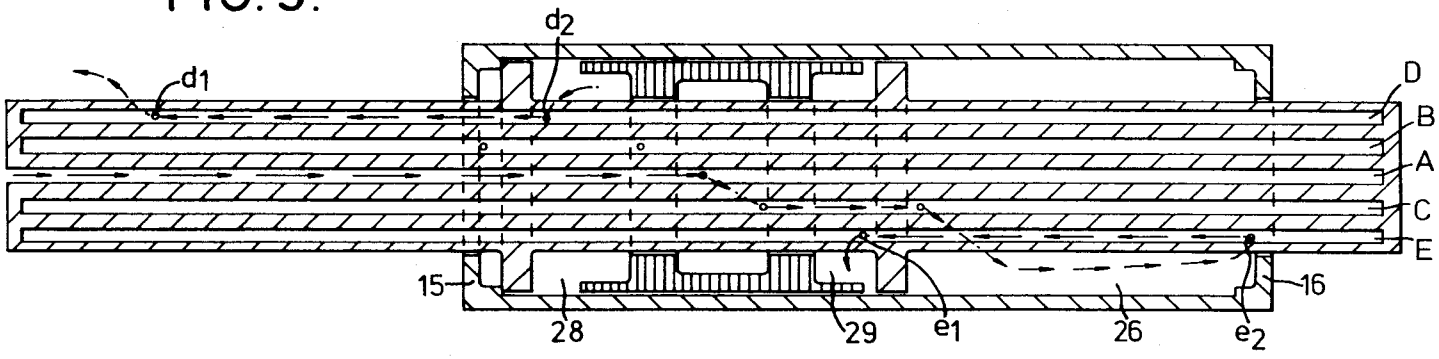

Rightward movement of the outer member 2 continues unitl the end wall 16 of the outer member 2 (as shown in FIG. 5) passes over the aperture e2 (usually this would be its extreme rightward position) thereby allowing air from the space 26 to pass through aperture e2 into passageway E and out through aperture e1 into compartment 29 to cause the shuttle member 3 to move leftwardly. Displaced air from the compartment 28 passes through aperture d2 into passageway D and exhausts to atmosphere through aperture d1.

Figure 6:
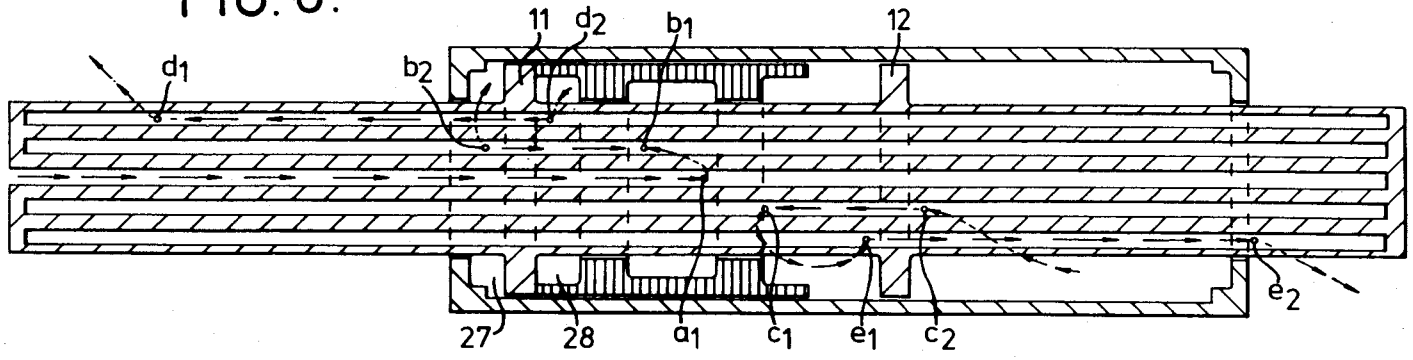

Referring to FIG. 6, the shuttle member 3 has moved to its extreme leftward position and air from passageway A passes out through aperture a1 into compartment 23, into passageway B through aperture b1 and into space 27 through aperture b2, to cause the outer member 2 to move to the left. The compartment 28 remains connected to atmosphere through aperture d2, passageway D and aperture d1. The displaced air from compartment 26 passes through aperture c2 into passageway C, out through aperture c1 into compartment 29, through aperture e1 into passageway E and exhausts to atmosphere through aperture e2. The movement of the outer member 2 continues until the end wall 15 passes over aperture d1. The air in compartment 27 then passes through aperture d1, passageway D and aperture d2 into compartment 28 to move the shuttle member 3 rightwardly to the position of FIG. 3 for the cycle to start again.

Brackets 30 connected to the outer member 2 by the nuts 17 and rods 18 can be used to secure an article to be reciprocated by the outer member 2. Alternatively the outer member 2 can be retained stationary and the article to be moved secured to the elongate member 1 by brackets 31.

The inner seals 21, 22 of the collar 20 forming the shuttle member 3 should preferably each be wider than the apertures b1 and c1 over which they respectively pass but can if desired each be provided by spaced O-ring seals to reduce friction.

Throughout the specification where "seals" are referred to, it is to be understood that a separate sealing member, such as a rubber ring, is not necessarily required and the seal may merely comprise relatively moving members so dimensioned as to provide a sealing effect.

Figure 2:
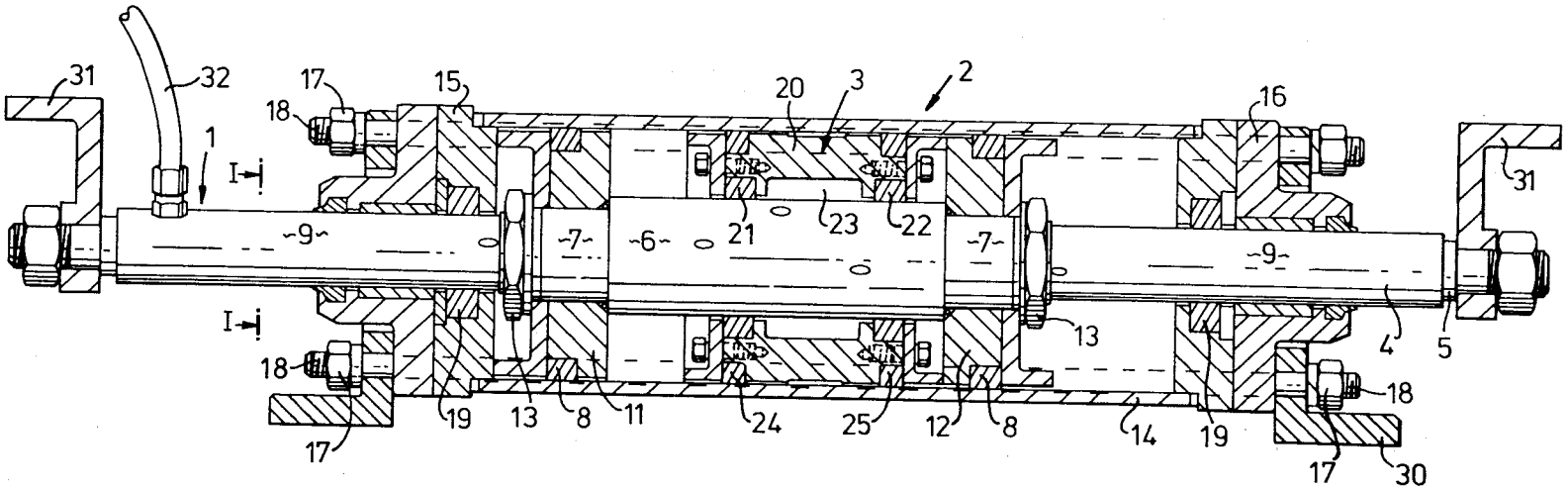
FIG. 2 is a sectional elevation of the reciprocating drive means of FIG. 1.

Air is supplied to channel A through a pipe 32 (FIG. 2) and the channel A has only one aperture a1 therein. Each of the other channels B, C, D and E has two apertures therein.

A liquid could equally be used as the driving fluid and might be particularly useful in a remote location where other power sources were not available but a head of water was available, for example from a storage tank.

By supplying a mixture of a combustible fluid and air through the channel A and providing ignition means in the compartments 26 and 27, the reciprocating drive means could be used as a one stroke, two cylinder combustion engine, non-return valves would however be required preferably at the location of the supply apertures c2 and b2 leading to the compartments 26 and 27 respectively.

By reciprocating the unit by drive means, it could be used as a compressor unit to provide a source of compressed fluid.

By mounting the unit on wheels or legs and providing it with claws or other engagement means, the unit could be caused, by its own reciprocating movement, to effect travelling movement over a surface, for example a plot of land, with water ejected from the unit used to irrigate the land.

What is claimed is:

1. Reciprocating drive means comprising an elongate inner member with a plurality of passageways therein, two fixed plates on said inner member, an outer member slidable on said inner member, a seal at the peripheral surfaces of each of said fixed plates to seal against the inner face of the wall of said outer member, an end wall on said outer member with a seal at said end wall slidable on said inner member, a shuttle member slidable with respect to said inner member between said two fixed plates and within said outer member, a seal at the outer peripheral surface of said shuttle member to seal against said inner face of the wall of said outer member and axially spaced seals at the inner peripheral surface of said shuttle member to seal against said inner member, a first compartment formed between said axially spaced seals, and ports in said inner member communicating respective ones of said passageways in said inner member with the surface thereof, said ports co-operating in use with the relatively moving said outer member and said shuttle member to effect valving operations to interconnect said passageways with one another and with compartments formed between said inner member and said outer member and separated from one another by said fixed plates and said shuttle member.

2. Reciprocating drive means as claimed in claim 1, wherein connection of a determined one of said passageways with a source of fluid pressure causes said outer member to move in one direction of movement with respect to said inner member followed by movement of said shuttle member in an opposite direction of movement on said inner member to cause said outer member to move in said opposite direction of movement followed by movement of said shuttle member in said one direction of movement.

3. Reciprocating drive means as claimed in claim 2, wherein, in operation, and with said shuttle member juxtaposed with a first one of said fixed plates and with said first one of said fixed plates juxtaposed with said end wall of said outer member, said fluid supplied axially through said determined one of said axially extending passageways in said inner member passes to said first compartment, passes from said first compartment to a second one of said passageways and from said second one of said passageways to a second one of said compartments located between said first one of said fixed plates and said end wall of said outer member, thereby to pressurize said second one of said compartments and to move said outer member axially with respect to said inner member in a first direction of movement, and said movement of said outer member in said first direction of movement causes said end wall thereof to pass over one of said ports which was venting to atmosphere a fourth one of said compartments located between said first one of said fixed plates and the adjacent end of said shuttle member thereby allowing fluid from said second one of said compartments to pass through a fourth one of said passageways to pressurize said fourth one of said compartments to move said shuttle member to a position juxtaposed with a second one of said fixed plates on said inner member.

4. Reciprocating drive means as claimed in claim 3, wherein said outer member has a second end wall at an opposite end thereof to said end wall and in operation and with said shuttle member juxtaposed with said second one of said fixed plates and with said second one of said fixed plates juxtaposed with said second end wall of said outer member, said fluid supplied axially through said determined one of said axially extending passages in said inner member to said first compartment passes from said first compartment to a third one of said passageways and from said third one of said passageways to a third one of said compartments located between said second one of said fixed plates and said second end wall of said outer member thereby to pressurize said third one of said compartments and to move said outer member axially with respect to said inner member in a second direction of movement, and said movement of said outer member in said second direction of movement causes said second end wall thereof to pass over one of said ports which was venting to atmosphere a fifth one of said compartments located between said second one of said fixed plates and the adjacent end of said shuttle member thereby allowing fluid from said third one of said compartments to pass through a fifth one of said passageways to pressurize said fifth one of said compartments to move said shuttle member to a position juxtaposed with said first one of said fixed plates on said inner member.

5. Reciprocating drive means as claimed in claim 4, wherein during expansion of said second compartment, said third compartment is vented through said third passageway, said fifth compartment and said fifth passageway and during expansion of said third compartment, said second compartment is vented through said second passageway, said fourth compartment and said fourth passageway.

6. Reciprocating drive means as claimed in claim 1, wherein said elongate inner member is a cylindrical shaft with a core member formed as a five-armed spider tightly fitted therein to form said passageways.

7. Reciprocating drive means as claimed in claim 1, wherein said elongate inner member is in the form of a flat member with the passageways arranged in a row and with said outer member slidable thereover in the form of a pressure pad.

8. Reciprocating drive means as claimed in claim 4, wherein said fluid pressure source is a source of a combustible fluid and air, and wherein ignition means are provided in said second compartment and in said third compartment whereby said reciprocating drive means operates as an internal combustion engine.

* * * * *